US005586668A

United States Patent [19]

Miller

[11] Patent Number: 5,586,668

[45] Date of Patent: Dec. 24, 1996

[54] IMBEDDED ELECTRICAL CONNECTOR

[75] Inventor: Craig A. Miller, Pittsburgh, Pa.

[73] Assignee: Westinghouse Air Brake Company, Wilmerding, Pa.

[21] Appl. No.: 355,839

[22] Filed: Dec. 14, 1994

[51] Int. Cl.[6] ..... B61G 5/00

[52] U.S. Cl. ..... 213/1.3; 213/76; 280/422; 439/35

[58] Field of Search ..... 213/1.3, 1.6, 76; 439/17, 29, 35; 280/422

[56] References Cited

U.S. PATENT DOCUMENTS

| | | | |
|---|---|---|---|
| 1,856,455 | 5/1932 | Banks et al. | 213/1.3 X |
| 2,475,051 | 7/1949 | Raymond | 439/29 X |
| 2,879,081 | 3/1959 | Keehn | 280/422 X |
| 3,251,480 | 5/1966 | DePenti et al. | 213/1.3 |
| 3,646,498 | 2/1972 | Reed | 213/1.3 X |
| 3,773,186 | 11/1973 | Reno et al. | 213/1.3 X |
| 3,812,444 | 5/1974 | Reno | 213/1.3 X |

FOREIGN PATENT DOCUMENTS

| | | | |
|---|---|---|---|
| 2257414 | 7/1973 | Germany | 213/1.3 |
| 3729520 | 3/1989 | Germany | 213/1.3 |

*Primary Examiner*—Mark T. Le
*Attorney, Agent, or Firm*—James Ray & Associates

[57] ABSTRACT

Electrical connections are provided between coupled railway cars by a connector which mates with the industry standard brake line air hose connector. Electrical contacts may be imbedded in the mating surfaces of two joined connectors, or on modules attached to the standard connector. The valve which admits air to the air hose connector after it is joined to another connector may also actuate a switch which completes electrical circuits when the air valve is opened. In cases where end to end reversal of a railway car would cause interchange of circuits, a compensating switch is provided.

25 Claims, 11 Drawing Sheets

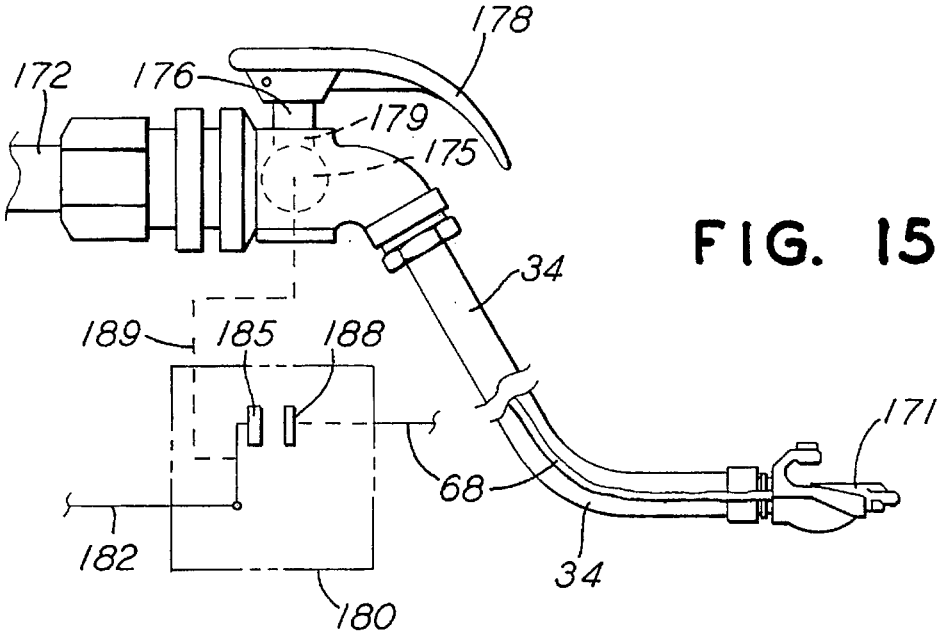
FIG. 15
FIG. 16
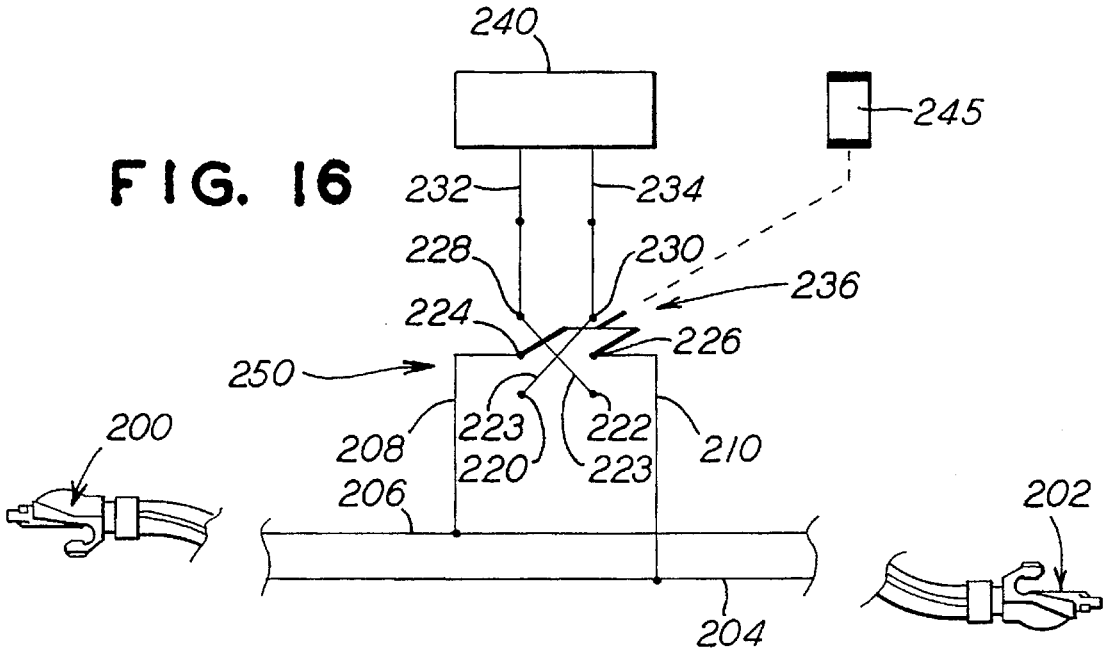

IMBEDDED ELECTRICAL CONNECTOR

FIELD OF THE INVENTION invention applies to the provision of electrical interconnections between railway cars. Such electrical interconnections may be used for voice intercom, rapid air brake application and release, power for electric lighting, control of remote locomotives, diagnostics such as information regarding hotboxes, and other purposes. Most particularly, the invention applies to the addition of electrical interconnection to the standard connector for the air line of the air brake system.

BACKGROUND OF THE INVENTION

The following four United States patents relate to the art of making electrical connections between electric lines in adjacent railway cars. U.S. Pat. No. 3,251,480, issued to K. L. DePenti et al on May 17, 1966: This patent provides a connector for automatic connection of fluid pressure conduits and electrical circuits. The connector is located underneath the coupler, and joining of the connectors is intended to occur automatically as the cars are coupled. This system is inconsistent with the industry standard brake line fluid pressure connector. No redundancy of contacts is provided, nor wiping action.

U.S. Pat. No. 3,646,498, issued to R. T. Reed et al on Feb. 29, 1972. This is an electrical connector which is not associated with a fluid pressure connector. Electrical contacts are embedded in insulating blocks, and are brought into electrical contact by pins activated when the connectors are joined. No redundancy of contacts is provided, nor wiping action.

U.S. Pat. No. 3,773,186, issued to W. H. Reno et al on Nov. 20, 1973. This patent has contacts in bores, which are placed in electrical contact by fluid pressure. No redundancy of contacts is provided, nor wiping action.

U.S. Pat. No. 3,812,444, issued to W. H. Reno on May 21, 1974. This is a combined fluid pressure connector and electrical connector which is inconsistent with the industry standard brake line fluid pressure connector. No redundancy of contacts is provided, nor wiping action.

SUMMARY OF THE INVENTION

In a first aspect, this invention provides a connector for joining fluid pressure communication conduits and electrical conduction lines on two coupled railway vehicles. The invention may be made to mate with the industry standard brake line fluid pressure connector, when used only for fluid pressure connection. The connector has a surface for mating two like connectors, the surface having a fluid pressure port, and compressible sealing means surrounding the fluid pressure port. It has a nipple for attaching a fluid pressure hose, and a passage joining the nipple to the fluid pressure port. It has means for joining two like connectors disposed in mating relationship, and applying pressure across the mating surface to compress the compressible sealing means. The connector has one or more electrical contacts on the mating surface, so that when two connectors are joined, at least one electrical interconnection is made between an electric contact on one connector and an electric contact on the other connector. Means are provided for connecting an electrical conduction line, such as a wire, to each electric contact.

In another aspect, this invention provides an electrical connector module which can be attached to a railroad car fluid pressure hose connector. The module has means for attachment to the fluid pressure hose connector, and has a surface for electrical interconnection, with electrical contacts on it, so that when two fluid pressure hose connectors are joined, each having a connector module attached, at least one electrical interconnection is made between electrical contacts on the two electrical connector modules. Means are provided for attaching electrical conduction lines, such as wires, to the electrical contacts.

In yet another aspect, this invention provides a system for joining fluid pressure communication conduits and electrical conduction lines on two coupled railway vehicles, while preventing electrically live contacts from being exposed. The system includes connectors for joining fluid pressure communication conduits and electrical conduction lines, and also includes a valve on each railway vehicle, which is associated with an electrical switch. The valve is analogous to the valve used in the present art, to admit fluid pressure to the fluid pressure connectors after they are joined. The moveable portion of the valve is connected to the moveable portion of the electrical switch, so that when the valve is opened, to admit fluid pressure from the fluid pressure communication conduit to the connector, the electrical switch is closed so as to make electrical connection between the electrical conduction lines and the electrical contacts in the connector.

With this system, when a connector is not connected to a connector on another railway car, the valve is shut off, because otherwise, fluid pressure would be lost through the fluid pressure port in the connector. Since the switch is operated with the valve, the operation of shutting the valve also turns off electric power to the electrical contacts in the connector.

However, when the connector is joined to another connector, on another railway car, and the fluid pressure valve is opened, electrical voltages are applied to the contacts through the switch which is operated with the valve.

In an additional aspect, this invention provides a system for joining fluid pressure communication conduits and electrical conduction lines on two coupled railway vehicles, with means for compensating for interchange of electric lines. The invention applies to cases in which so many electrical conduction lines are required that it is necessary to have more than two contacts at a given radius from the center of the fluid pressure connection, on either the mating face of the connector, or on an auxiliary module.

The significance of exceeding two contacts at a given radius is that for that case, interchange of lines becomes a problem. For two lines, one contact can be directly above the fluid pressure port, and one contact can be directly below. These contacts, and lines connected to them, retain their character even if one or more of the railroad vehicles are reoriented end-to-end, as is common in freight trains.

However, if there are more than two contacts at a given radius, then they become interchanged if the vehicles are reoriented end-to-end.

To compensate for interchange of lines, use is made of a multipole, double-throw switch which is automatically thrown by a relay when a railway car is connected to another railway car which has energized lines.

In an additional aspect, this invention provides a method for interconnecting electrical conduction lines on two coupled railway vehicles. This is done by providing electrical contacts on the connectors, so that when they are joined to make fluid pressure connection, electrical contacts are also made.

OBJECTS OF THE INVENTION

The principal object of this invention is to provide method and apparatus for making electrical connections between electrical conduction lines on two coupled railway vehicles.

It is a further object to base this on the industry standard brake line fluid pressure connector, which is generally an air hose connector, for the following reasons:

(1) The industry standard fluid pressure connector, which is joined by hand, has been preferred over automatic connectors for the harsh environment of freight trains. Although automatic connectors have worked in passenger service, they have not worked well for freight trains. Hence, a preference for manually joined connectors is anticipated.

(2) To facilitate introduction of this connector into an environment dominated by the industry standard brake line connector, it is desirable to have it be compatible with the industry standard in regard to the brake line connection. Hence, a railway car equipped with this connector can be used in a train with cars similarly equipped to provide both brake line connection and electrical connections along the length of the train. It can also be used in other trains with cars having the industry standard connectors, to provide the required brake line connection, although in that case, electrical connection would not be provided.

It is a further object to provide an electrical connector which makes connection when the brake line connection is made, to avoid adding an extra task for railway personnel.

It is an additional object to provide a wiping action which scrapes the electrical contact surfaces and removes insulating substances such as oxide layers.

It is an additional object to provide redundancy of electrical interconnections, so that when a connector on one railway vehicle is mated to a connector on a second railway vehicle, at least two electrical interconnections are made through contacts on the mating surfaces of the connectors, to provide redundant paths for electric current flow between an electric conduction line on one vehicle and an electric conduction line on the other vehicle.

In some of the referenced patents, fluid pressure is used to make and break electrical contacts, so that contact can be made quickly to avoid arcing and burning of contacts. It is an object of the present invention to provide a more robust method for energizing the electrical circuits after the connections are made. Energization of circuits may be done after connections are made by incorporating an electrical switch with a valve which admits fluid pressure. Hence, when railway personnel open the valve to admit fluid pressure to the connector, electrical circuits are likewise energized. One advantage of this approach is that after a full brake application, the line pressure would be so low that, with the prior inventions, electrical contacts would be broken. By using an electrical switch associated with the fluid pressure valve, this can be prevented.

Various additional objects and advantages may be apparent to one skilled in the art, based on the embodiments discussed below, and the appended claims.

BRIEF DESCRIPTION OF THE DRAWINGS

FIG. 15 schematically illustrates a switch for energizing the contacts in the connector when the air valve is opened. FIG. 16 shows a crossover switch which compensates for interchange of circuits which may occur when a railway vehicle is reoriented end-for-end.

BRIEF DESCRIPTION OF THE INVENTION AND THE PRESENTLY PREFERRED EMBODIMENTS

Figure 1:
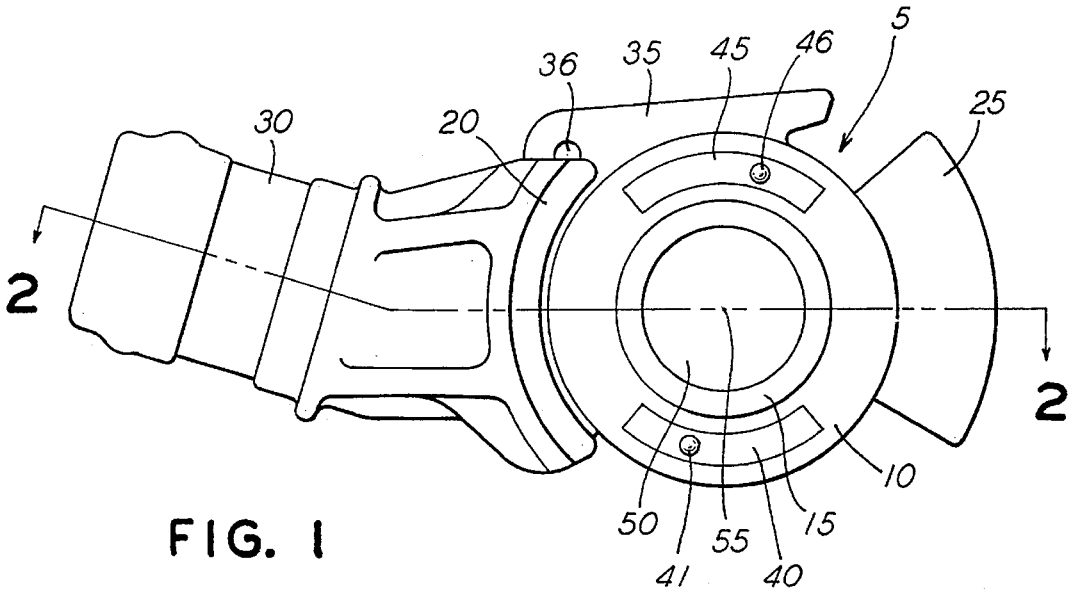
FIG. 1 is a view of the connector of this invention. The viewing direction in this figure is normal to the mating surface of the connector. This figure shows a connector having two electrical contacts on the mating surface of the connector.

The invention, in its most basic form, is shown in FIG. 1. The connector for fluid pressure and electrical conduction lines is shown generally at 5. Item 10 denotes the mating surface of the connector, and 15 denotes compressible sealing means, which may be a rubber gasket. Items 20 and 25 are arcuate projections. When two such connectors are brought together, in an angular relationship such that their arcuate projections 20 and 25 pass each other, until their fluid pressure ports are juxtaposed, and then rotated relatively about an axis passing through the centers of their fluid pressure ports, these arcuate projections engage. Projection 20 is toward the viewer in FIG. 1, and projection 25 is away from the viewer. When two such connectors are joined, projection 20 of one connector engages projection 25 of the other connector, and vice versa. These arcuate projections have tapered lead-in regions such that as they are joined and rotated, the two connectors are forced together and held under pressure. In this manner, the resilient sealing means of the connectors are compressed.

Item 30 is a nipple to which a fluid pressure hose is attached. Item 35 is a top web which has a carrier hole, 36. A bungee (not shown), which supports the connector is attached to the carrier hole.

Item 40 is an arcuate electrical contact surface, and Item 41 is a button with resilient mounting means which protrudes through and is electrically connected to the arcuate contact surface, 40.

Likewise, Item 45 is an arcuate electrical contact surface, and Item 46 is a button with resilient mounting means which protrudes through and is electrically connected to the arcuate contact surface, 45.

Item 50 is the fluid pressure port, and item 55 is the center of the fluid pressure port.

Figure 2:
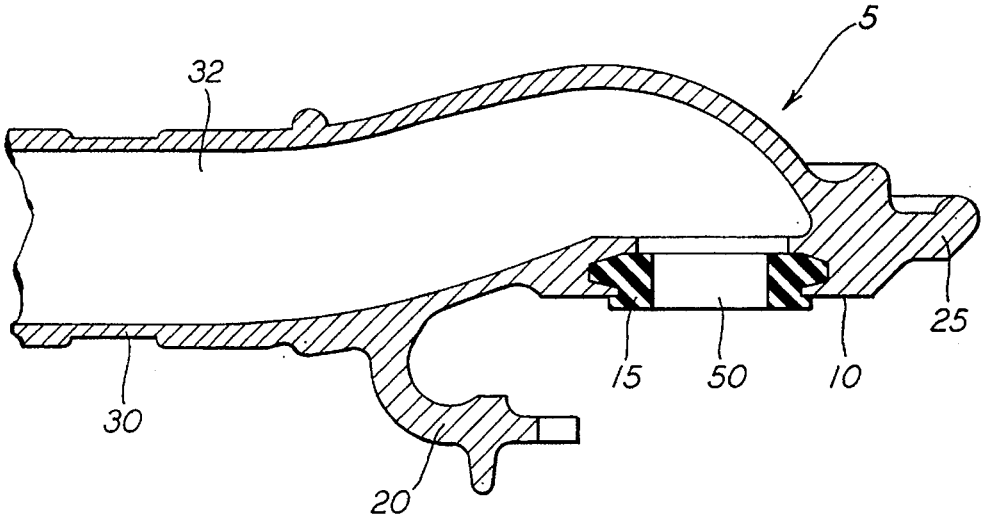
FIG. 2 is a sectional drawing made on the surface indicated as A–A' in FIG. 1.

FIG. 2 shows a section cut along surface A–A' of FIG. 1. This figure shows the mating surface 10 and the compressible sealing means, 15. The arcuate projections which join two connectors are shown as 20 and 25. Item 30 is a nipple for attachment of the fluid pressure hose, and 32 is a fluid pressure communication passage which connects the nipple 30 to the fluid pressure port, 50.

Figure 3:
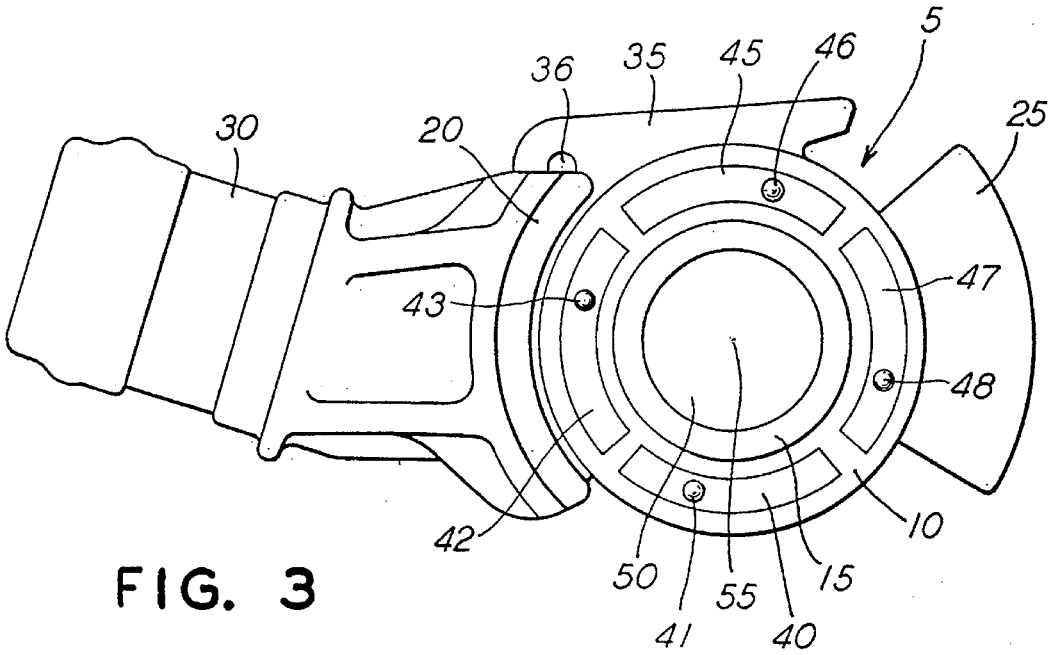
FIG. 3 is a drawing similar to FIG. 1, except that four contacts are shown on the mating surface of the connector.

FIG. 3 is a view similar to FIG. 1, but it shows a connector which has four electrical contacts on the mating surface, 10.

As in the preceding embodiment, one contact comprises arcuate contact surface 40 and button with resilient mounting means, 41. Also, another contact is arcuate contact surface 45 and resiliently-mounted button, 46.

Items 42 and 43 comprise an additional electrical contact. Item 42 is an arcuate contact surface, and Item 43 is a resiliently mounted button.

Likewise, Items 47 and 48 comprise a fourth electrical contact. Item 47 is an arcuate contact surface, and Item 48 is a resiliently mounted button.

Figure 4:
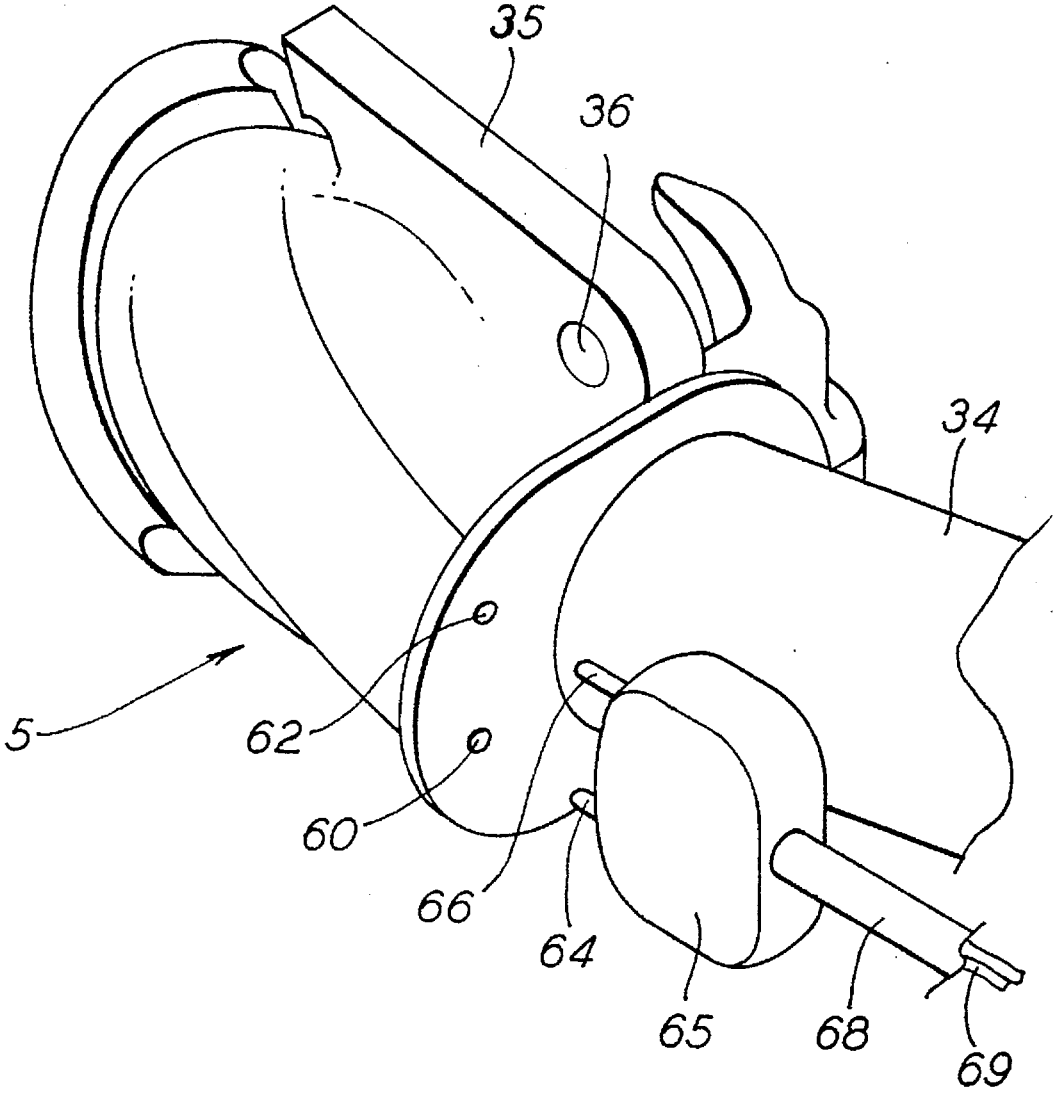
FIG. 4 is a perspective drawing which shows plug and receptacle means for joining electrical lines to the connector.

FIG. 4 is a perspective drawing which shows means for attachment of electrical conduction lines to the connector. As in the preceding figures, the connector is shown at 5. Item 35 is the top web, and Item 36 is the carrier hole. Item 34 is the fluid pressure hose placed over the nipple, 30, which is not shown in this figure.

Item 65 is an electrical plug which terminates the cable, 68, which carries the individual electric conduction lines, 69. The plug has connector prongs 64 and 66 which mate with receptacles 60 and 62 in the body of the connector, 5.

Figure 5:
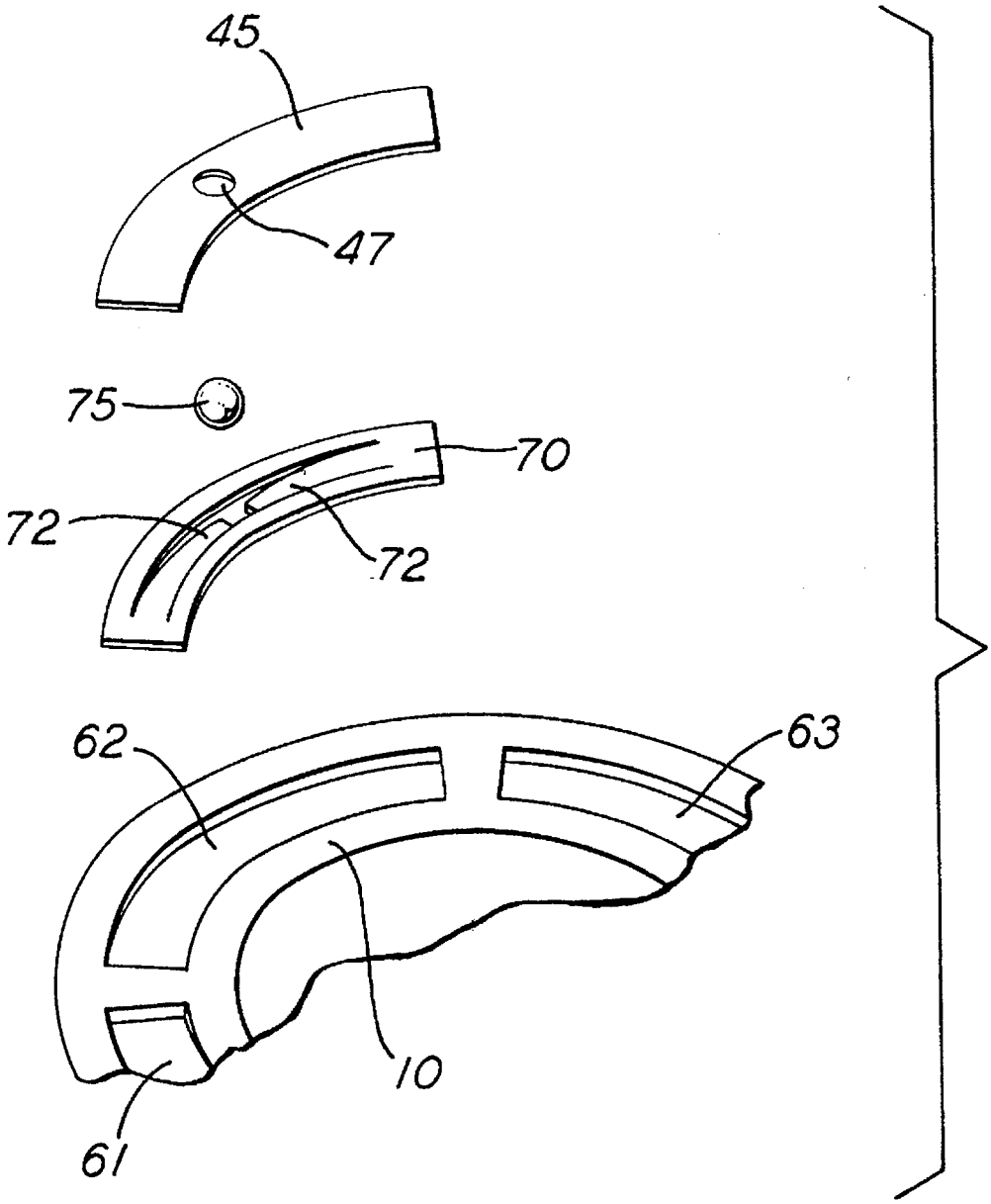
FIG. 5 is an exploded view showing tensioning electrical contact fingers supporting a ball contact.

FIG. 5 is an exploded view of an embodiment in which the resiliently-mounted button is a spring-loaded ball 75, which may be made of stainless steel. Item 45 is an arcuate contact surface which may, for example, be made of beryllium-copper. Item 70 is a finger plate, which has resilient fingers, 72. These fingers support the ball, 75, and cause it to protrude through a hole, 47 in the arcuate contact surface, 45.

The finger plate, 70, the ball, and the arcuate contact surface, 45 fit into a recess 62 in the mating surface, 10 of the connector. The mating surface, 10 is made of an insulating material.

Items 61 and 63 are additional recesses in the mating surface 10, to accommodate additional contacts, which are not shown.

Figure 6:
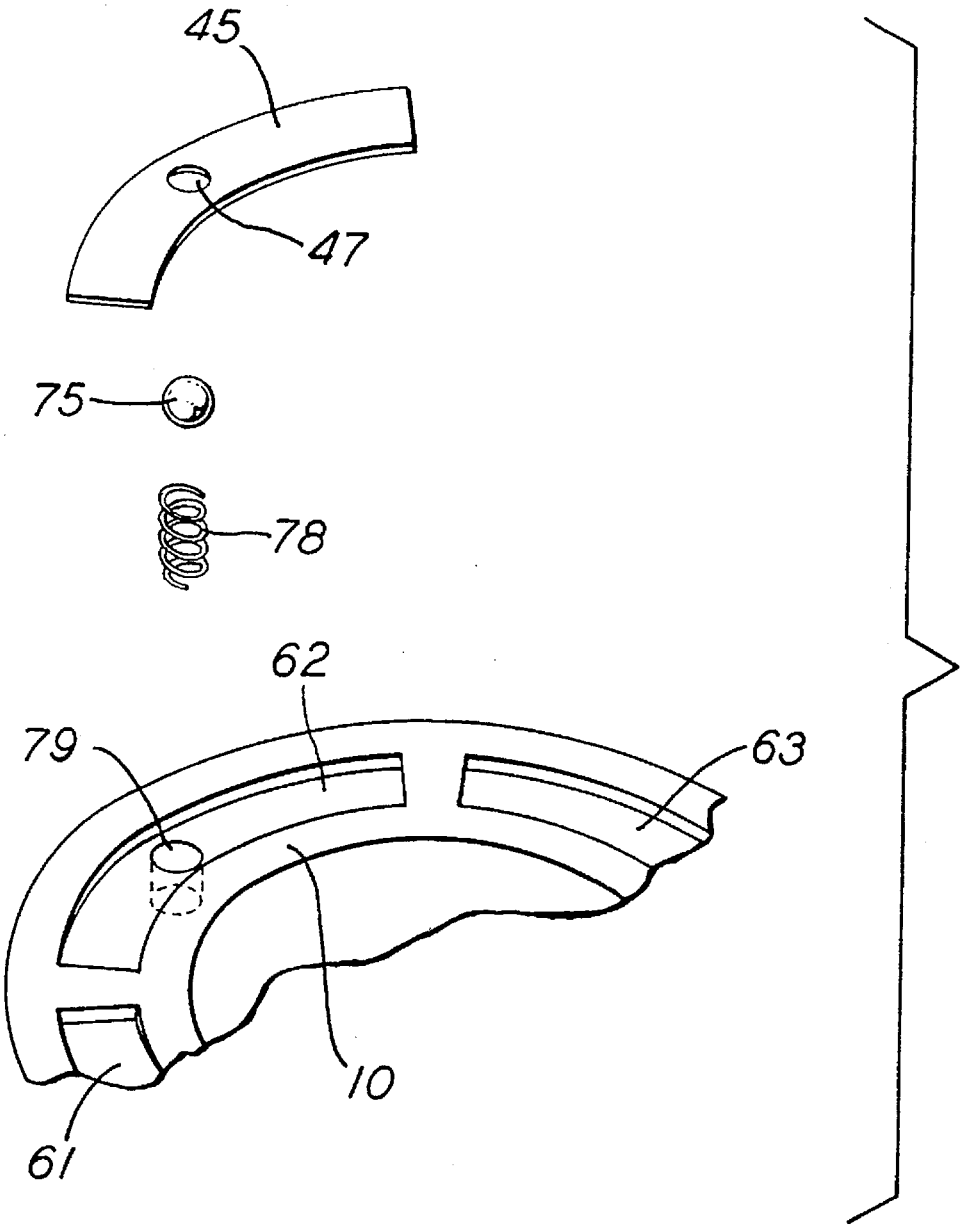
FIG. 6 is an exploded view showing a ball contact supported by a coil spring mounted in an electrically conductive socket.

FIG. 6 shows alternative resilient mounting means. As before, Item 45 is an arcuate contact surface having hole, 47. A ball contact 75 is supported by coil spring 78 which is contained in an electrically-conductive socket 79. The ball contact 75 protrudes through the hole 47. The arcuate contact surface 45 fits into a recess 62 in the mating surface 10, which is non-conductive. Additional recesses 61 and 63 accommodate additional contacts, which are not shown. The electrically-conductive socket, 79 is connected electrically by means not shown to the arcuate contact surface, 45.

Figure 7:
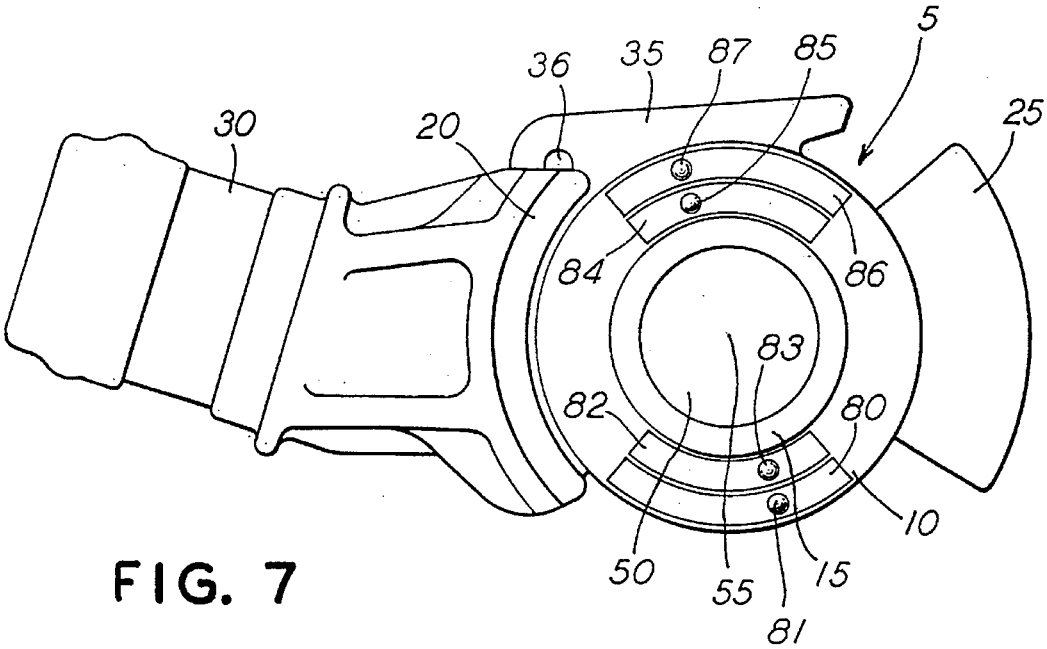
FIG. 7 shows a connector having electrical contacts disposed at two different radii from the center of the fluid pressure port.

FIG. 7 shows an embodiment in which contacts are disposed at two different radii from the center, 55 of the fluid pressure port, 50. Items 80 and 81 comprise a first contact on the mating surface, 10, which is non-conducting. Items 82 and 83 comprise a second contact, Items 84 and 85 comprise a third contact, and Items 86 and 87 comprise a fourth contact. Items 80, 82, 84, and 86 are arcuate contact surfaces, and Items 81, 83, 85, and 87 are resiliently loaded buttons. These may be spring-loaded balls. In each case, the spring-loaded button is electrically connected to the arcuate contact surface in which it is mounted.

Figure 8:
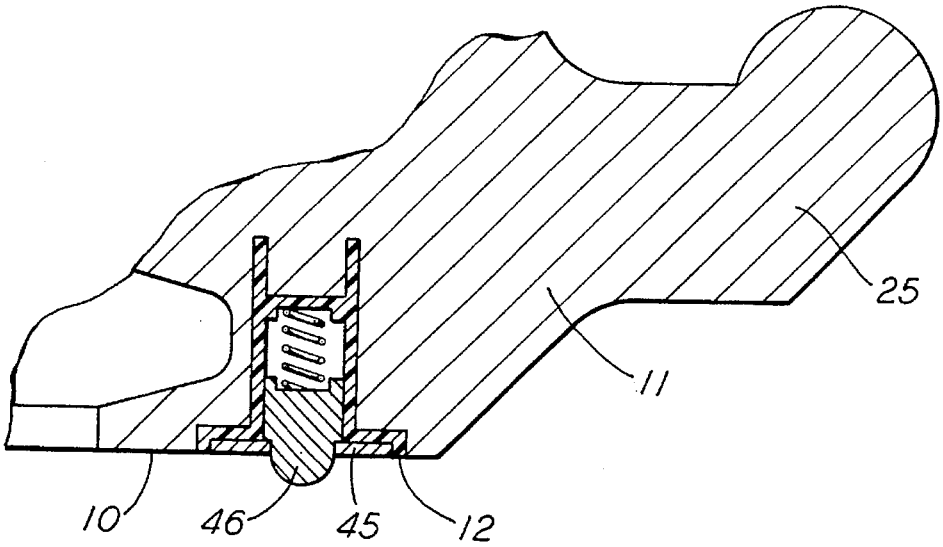
FIG. 8 shows a contact which is electrically insulated from the connector body, which may be electrically conductive.

FIG. 8 is a sectional drawing through a contact in an alternate configuration in which a non-conducting insert 12 is disposed between the contact, comprising arcuate contact surface, 45 and spring mounted button 46, and the connector body 11. The connector body 11 having mating surface 10 is made of an electrically conductive material, which may be a metal.

Figure 9:
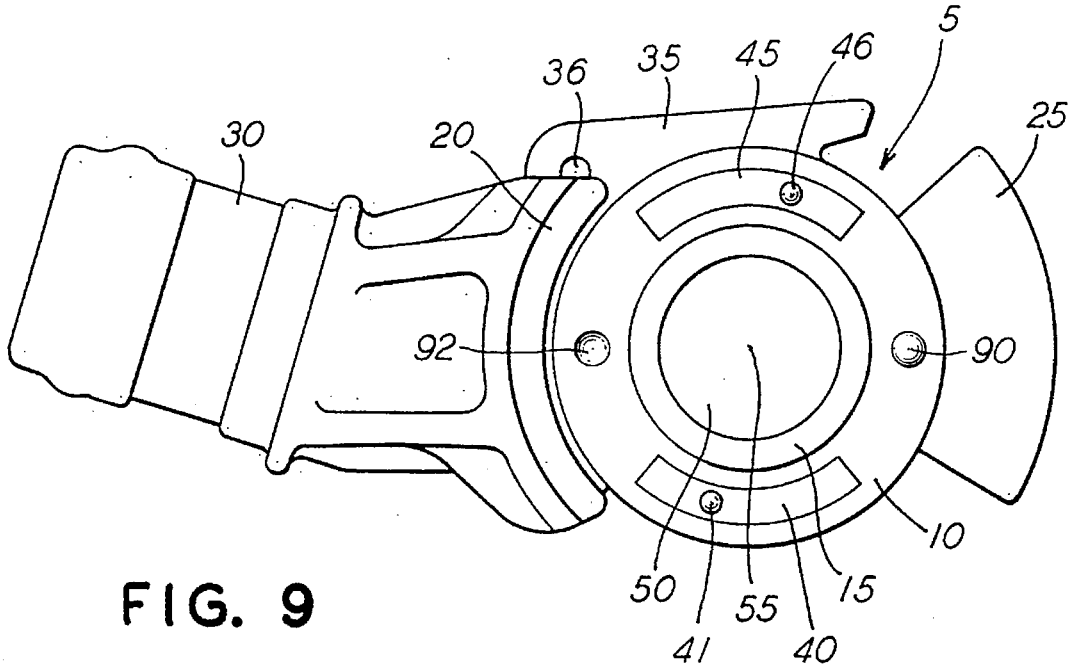
FIG. 9 shows a connector with a detent added to position the connector at a fixed angular position.

FIG. 9 shows an embodiment in which a detent is added to establish a fixed angular relationship between two mated connectors. Item 90 is a resiliently mounted button, which may be a spring-loaded ball. Item 92 is a hole in the surface 10.

When the two connectors, a first connector and a second connector, are brought together in mating relationship, the button 90 on the first connector drops into the hole 92 on the second connector, and the button 90 on the second connector drops into the hole 92 in the first connector. These provide a detent effect, which tends to position the two connectors at a fixed angular relationship. In each, the portion of the button which protrudes into the hole on the opposite connector should have sufficient taper or slope that the detent effect can be overcome without harm to the button 90 or hole 92 if a large torque is applied to cause relative rotation of the two connectors, as occurs when the two connectors are separated.

Figure 10A:
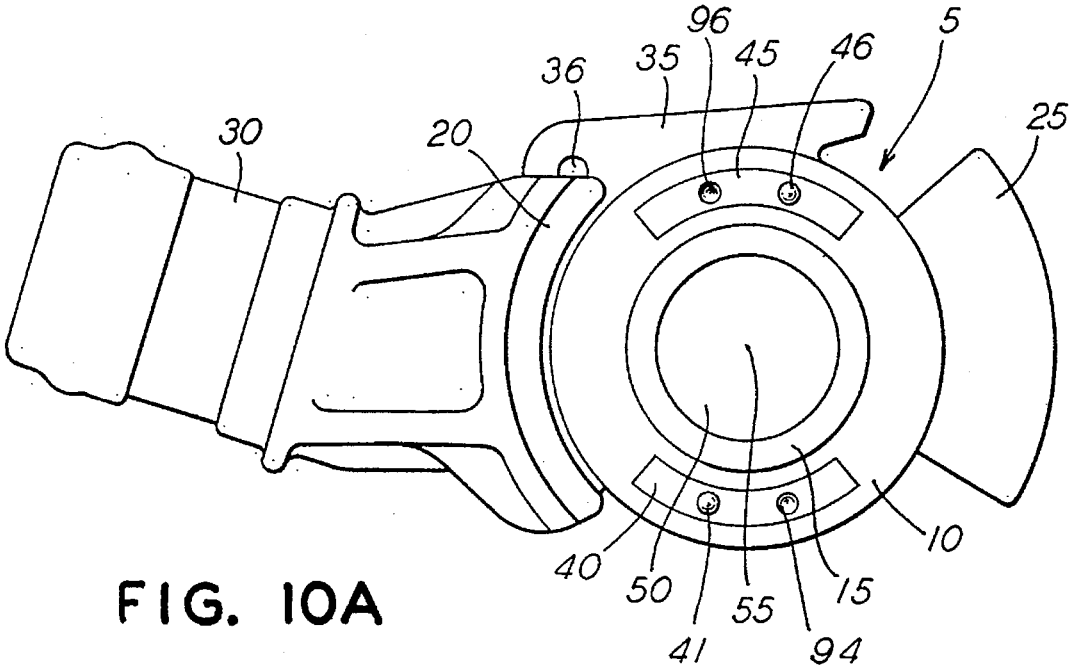
In Figure 10A, the electrical contact itself serves as a detent, in FIG. 10B, a detent effect is provided in two angular positions, and in FIG. 10C, a detent effect is provided in a range of angular positions.

The detent effect may be provided by the resiliently supported buttons which are used for electrical contact. FIG. 10A shows a connector having arcuate contact surfaces 40 and 45, which has resiliently-supported button contacts 41 and 46. To provide a detent effect, depressions 94 and 96 are formed in the arcuate contact surfaces 40 and 45. When a first connector and a second connector are brought together and joined in a mating relationship, buttons 46 and 41 on the first connector drop into depressions 96 and 94, respectively on the second connector. Likewise, buttons 46 and 41 on the second connector drop into depressions 96 and 94, respectively on the first connector. The depressions 96 and 94 may be in the form of dimples in the arcuate contact surfaces 40 and 45.

Figure 10B:
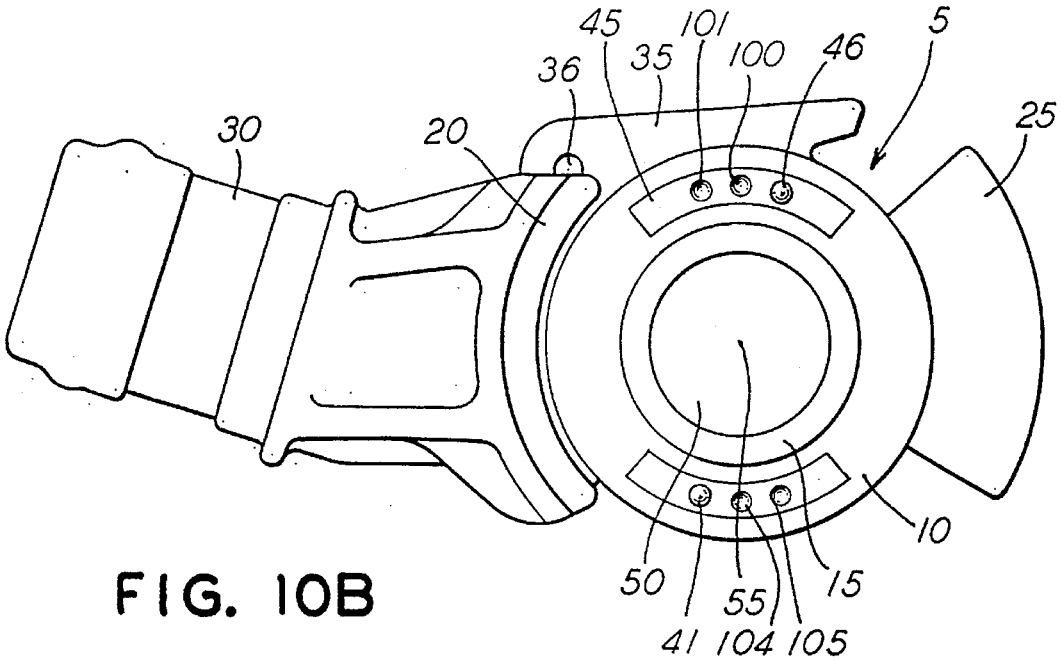

In another embodiment, a plurality of dimples are formed on the arcuate contact surfaces, so that low-energy positions are established for the couplers at a plurality of relative angular positions. In FIG. 10B, the arcuate contact surface 45 has two dimples, 100 and 101. Likewise, the arcuate contact surface 40 has dimples 104 and 105. In the figure, both dimples are on the same side of the button. It is also possible for dimples to be disposed on opposite sides of the button.

When a first connector of this type is brought together with a second connector of this type, and joined in mating relationship, the resiliently loaded button 46 on one connector finds two positions of low energy, either in dimple 100 or dimple 101 on the opposite connector. Likewise, the resiliently loaded button 41 on one connector finds two positions of low energy, either in dimple 104 or dimple 105 on the opposite connector.

Figure 10C:
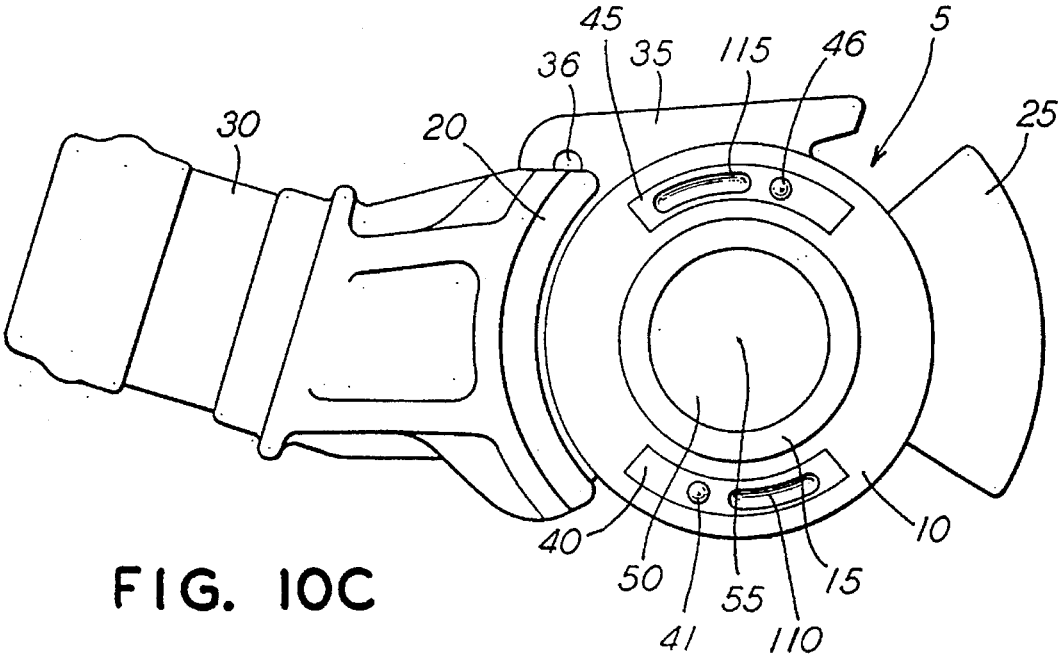

In another embodiment, arcuate depressions are formed on the arcuate contact surfaces, so that a low-energy position is established for the couplers in a range of relative angular positions. In FIG. 10C, the arcuate contact surface 45 has an arcuate depression, 115. Likewise, the arcuate contact surface 40 has arcuate depression 110.

When a first connector of this type is brought together with a second connector of this type, and joined in mating relationship, the resiliently loaded button 46 on either connector finds a low energy configuration in a range of relative angular positions in the arcuate depression 115 on the opposite connector. Likewise, the resiliently loaded button 41 on either connector finds a low energy configuration in a range of relative angular positions in the arcuate depression 110 on the opposite connector.

For all of the configurations shown in FIGS. 10A, 10B and 10C, alternative embodiments are possible in which at least one depression is formed on either arcuate contact surface 40 or arcuate contact surface 45, but not on both.

Figure 11:
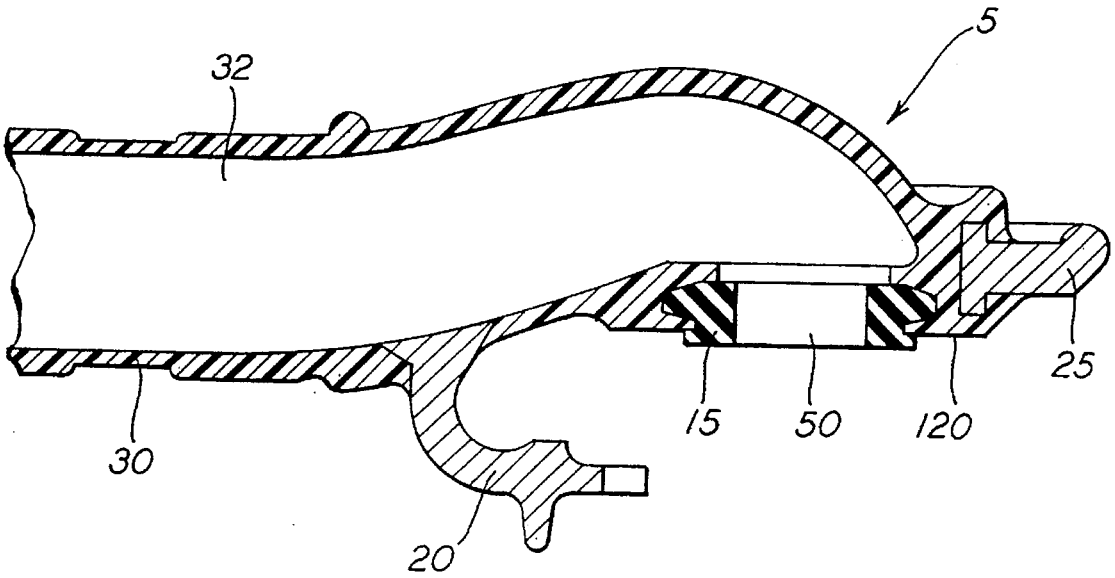
In FIG. 11, the connector body is non-conducting, and the projections which hold two connectors together are used for additional contacts.

In another embodiment of the invention, one or more additional electrical connections are provided by using the projections which hold the two connectors together. FIG. 11 shows a view of such a connector. Item 120 is the body of the connector, which is made of a non-conducting material. Item 15 is the compressible sealing means. Projections 20 and 25, which hold the connectors together, are made of conductive material, which may be a metal. Each of these projections is connected to an electric conduction line (not shown). It is desirable to coat the surfaces of projections 20 and 25 which are not the engaging surfaces where electrical contact is made, with an electrically insulating layer. Electrical contacts made through projections 20 and 25 are particularly suitable for neutral or ground lines, due to their relatively exposed positions.

In another embodiment of this invention, electrical connection between railway cars is provided by an electrical connector module which is attached to the industry standard fluid pressure hose connector.

Figure 12:
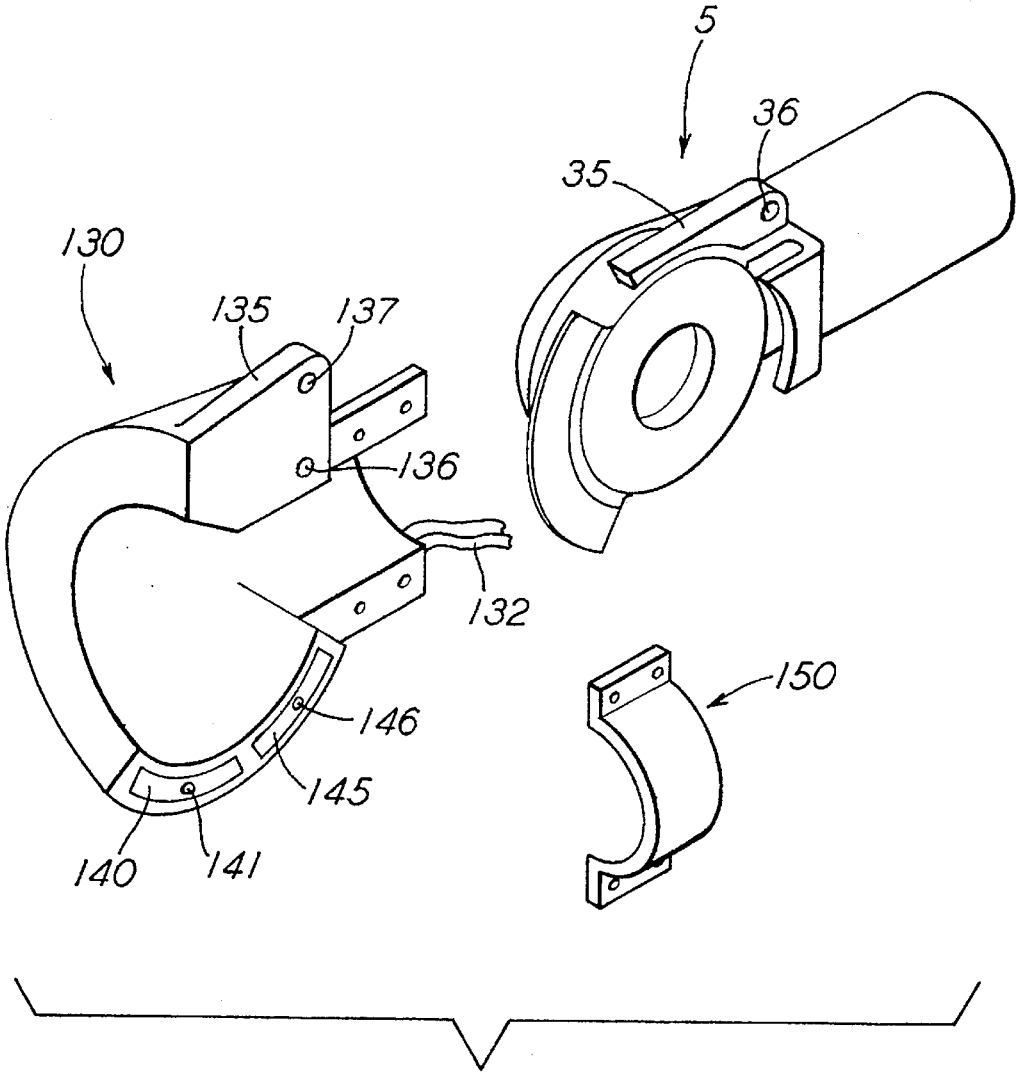
FIGS. 12 and 13 show modules for attachment to the standard fluid pressure connector.

FIG. 12 shows an embodiment in which an electrical connector module 130 is provided which attaches to the industry standard fluid pressure connector 5. The standard connector has top web 35 with carrier hole 36. The connector has connector top web 135 and mounting hole 136. This hole is for bolting to the carrier hole 36 on the standard connector. Hole 137 is provided on the connector top web for use as a substitute carrier hole, for attachment of the bungee (not shown) which supports the connector.

The connector has electrical contacts 140 and 145 on its lower portion. These may have resiliently mounted buttons 141 and 146. The electrical lines attached to the contacts 140 and 145 are indicated as 132. Item 150 is used for attaching the module to the industry standard fluid pressure connector.

Figure 13:
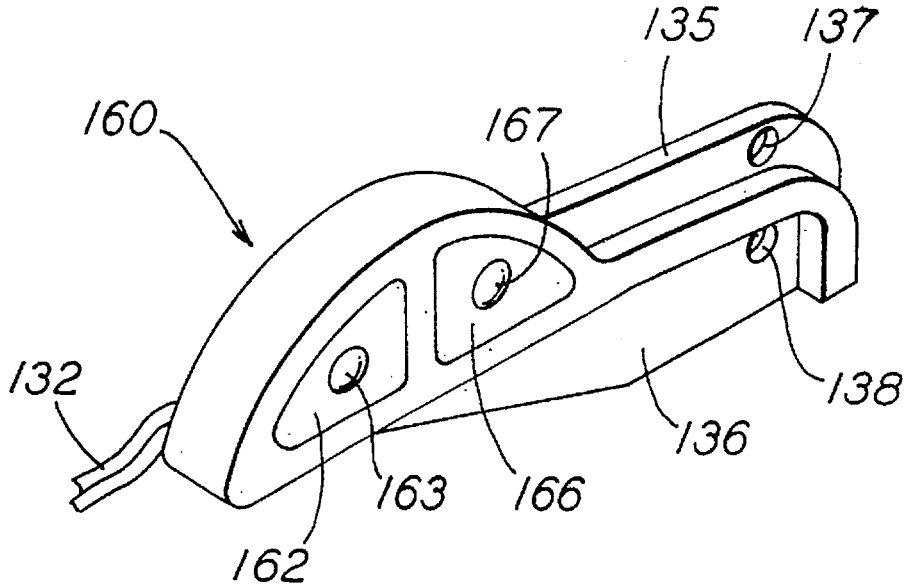

FIG. 13 shows an alternative embodiment in which an electrical connector module 160 is mounted so as to attach only to the upper portion of the industry standard connector.

Module lower web 136 has a hole 138 for attachment to the carrier hole 36 in web 35 of the standard connector. Module top web 135 has a substitute carrier hole 137.

This module provides electrical contacts 162 and 166, which may have resiliently mounted buttons 163 and 167 respectively. The electrical lines which are connected through this module are shown at 132.

Figure 14:
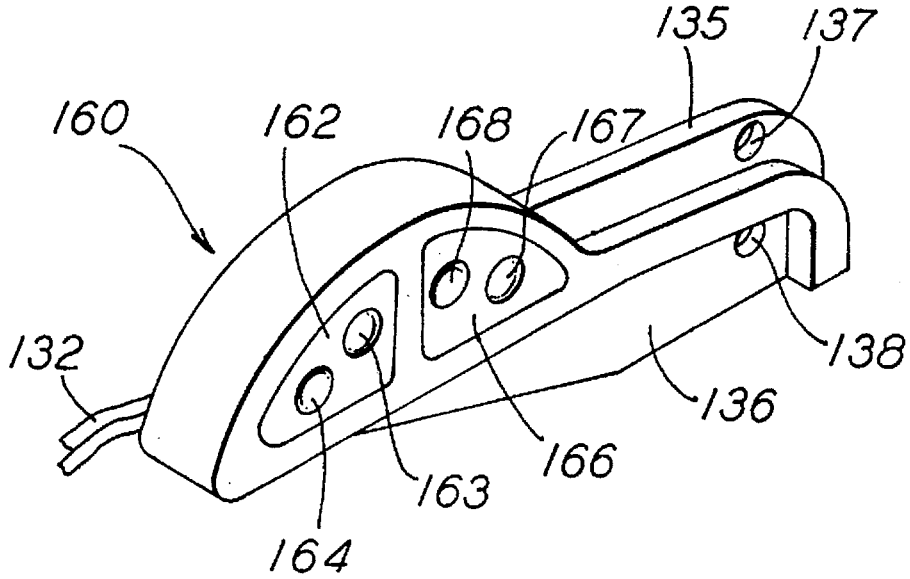
FIG. 14 shows a module with a detent.

FIG. 14 shows an embodiment of the module 160 in which a detent is provided. As in the preceding figure, items 163 and 167 are resiliently mounted button contacts. To provide a detent, electrical contact 162 is formed with a depression 164, and electrical contact 166 is formed with a depression 168.

When two fluid pressure connectors with such modules are attached, buttons 163 and 167 on each module drop into the depressions 164 and 168 on the opposite module, to provide a detent effect.

In each case above, for the electrical connector module, the resiliently mounted button may be a spring loaded ball.

FIG. 15 schematically illustrates an embodiment of this invention in which an electrical switch, 180 is provided, which is connected to a valve 170. The valve 170 controls fluid pressure from conduit 172 on the railway vehicle to conduit 34 which goes to connector module 171, which provides fluid pressure and electrical connection between two coupled railway vehicles.

The valve has moveable portion 175, and means for moving it, 177, which may be a handle 178 on a shaft, 176. Means 179 are provided for connecting the means for moving 177 to the moveable portion 175. The means for connecting may be an extension of shaft 176.

The electrical switch 180 has moveable portion 185 which makes and breaks contact with electrical contact 188. This closes the circuit between electrical conduction line 182 on the railway vehicle and electrical conduction line 68 which is attached to the connector 171. Means 189 are provided for connecting the moveable portion of the valve 175 with the moveable portion of the switch 185. Means 189 may include a shaft which rotates with shaft 176.

It is desirable for the electrical switch to operate with a snap action so that electrical contacts are made and broken quickly, to prevent arcing and burning of contacts.

A further embodiment of this invention provides apparatus for distinguishing between more than two circuits connected at a common radius in the connector, or in a connector module. Reference is made to FIG. 3, which shows four circuits having contacts at a common radius.

When a first connector 5 shown in FIG. 3 is joined to a second connector, the following interconnections are made:

(a) Contact 45 on the first to contact 45 on the second.

(b) Contact 40 on the first to contact 40 on the second.

(c) Contact 42 on the first to contact 47 on the second.

(d) Contact 47 on the first to contact 42 on the second.

Hence, an electrical conduction line connected to contact 45 retains its character from one railway vehicle to the next. Likewise, an electrical conduction line connected to contact 40 retains its character from one railway vehicle to the next.

However, electrical conduction lines connected to contacts 42 and 47 interchange their character from one railway vehicle to the next. This cannot be resolved by any simple crossover of lines because for freight trains, the railway vehicles may be reoriented end for end.

FIG. 16 schematically illustrates a system which compensates for interchange of circuits due to reorientation end for end.

Items 200 and 202 represent connectors for fluid pressure and electrical circuits at opposite ends of a railway vehicle (not shown). Electrical conduction lines 204 and 206 connect a pair of circuits between connector 200 and connector 202. The circuits shown are circuits which interchange their character when the railway vehicle is reversed. Item 240 is an electrical or electronic unit which is connected to the lines 204 and 206. Apparatus is provided for compensating for interchange of information or voltage on the lines 204 and 206. This is done using, for each pair of circuits which tend to interchange, a switch 250 of the familiar double pole, double throw type, wired as shown.

Contacts of the switch are denoted 220,222,224,226,228 and 230. Contact 224 is connected to line 206 by branch line 208, and contact 226 is connected to line 204 by branch line 210.

To interchange the circuits, contact 222 in the switch is connected to contact 228 by conduction path 223, and contact 220 is connected to contact 230 by conduction path 221. Item 236 is the moveable portion of the switch. In a first closed position, item 236 connects contact 224 to contact 220 and contact 226 to contact 222. In a second closed position, item 236 connects contact 224 to contact 228 and contact 226 to contact 230.

Connection is provided between contacts 228 and 230 and the electrical or electronic unit 240 through the lines 232 and 234. Hence, by use of the double pole-double throw switch 250, wired as shown, interchange of the circuits 204 and 206 due to end to end reorientation of the railway vehicle can be corrected on the lines to the electrical or electronic apparatus, 240.

Item 245 is a latching relay which moves the switch 250 from one closed position to the other. It is actuated by a signal or a voltage on circuits such as 204 and 206 which interchange their character when the railway car is reoriented end to end.

PRESENTLY MOST PREFERRED EMBODIMENT

The embodiment most preferred at the present time is a connector of the type shown in FIG. 1, which provides for two circuits. These may be used for AC power. They can also, at the same time, be used for transmitting information by the use of a radio frequency carrier signal imposed on these circuits. Control information, diagnostic information, voice intercom, etc, can be modulated and transmitted on these two circuits by using the RF carrier. For a specific example, FM modulation could be used. This technology is available for example, in intercoms which send voice communications over residential 120 volt, 60 Hz wiring.

In a modification of this most-preferred embodiment, the projections 20 and 25 which hold a pair of connectors together, may be used to provide a ground path. One purpose of the ground path would be to prevent either of the two power circuits from attaining a dangerous voltage relative to ground.

We claim:

1. A connector for joining a fluid pressure communication conduit and at least one electrical conduction line on a first railway vehicle to a like connector on a second railway vehicle coupled to such first railway vehicle, said connector comprising:

(a) a connector body including;

(I) a surface for mating two like connectors, said surface having a fluid pressure port, said fluid pressure port having a center, and compressible sealing means surrounding said fluid pressure port;

(II) a nipple for attachment of a fluid pressure hose, said connector body having formed therein a fluid pressure communication passage joining said nipple to said fluid pressure port;

(III) means for mechanically joining two connectors disposed with their said mating surfaces in contact wherein force is applied across their said mating surfaces so said sealing means are compressed and a fluid seal is provided;

(b) at least one electrical contact on said mating surface, said at least one electrical contact including a button with resilient mounting means and a plate having an arcuate contact surface electrically connected to said button so that when a first connector is joined to a second connector, said button with resilient mounting means on said first connector makes an electrical interconnection with said arcuate contact surface on said second connector, and said button with resilient mounting means on said second connector makes an electrical interconnection with said arcuate contact surface on said first connector, through which redundant electrical interconnection is provided between said at least one electrical contact on said first connector and said at least one electrical contact on said second connector; and (c) means for connecting at least one electrical conduction line to said at least one electrical contact.

2. A connector according to claim 1 wherein said button with resilient mounting means is a spring loaded ball.

3. A connector according to claim 1 wherein said arcuate contact surface is further characterized as having a hole therein, with said button with resilient mounting means positioned so as to protrude through said hole.

4. A connector according to claim 1 wherein said resilient mounting means comprises a coil spring.

5. A connector according to claim 4 wherein said coil spring is in electrical contact with said button, and further, said coil spring is positioned in an electrically conductive socket, said electrically conductive socket being electrically connected to said arcuate contact surface.

6. A connector according to claim 1 wherein said resilient mounting means comprises a resilient finger in electrical contact with said button, said resilient finger being electrically connected to said arcuate contact surface.

7. A connector according to claim 1 wherein said at least one electrical contact comprises a set of electrical contacts disposed at a common radius from said center of said fluid pressure port.

8. A connector according to claim 1 wherein said at least one electrical contact comprises at least two sets of electrical contacts; said contacts in any one of said at least two sets being at a common radius; said common radius of any one set being unequal to said common radius of any other set in said at least two sets.

9. The connector of claim 1 wherein said connector body is made of a material which is electrically non-conducting.

10. The connector of claim 1 wherein said connector body is made of a material which conducts electricity, said connector further comprising an insulating insert between said at least one electrical contact and said connector body.

11. A connector according to claim 1 further comprising a detent so that when two of said connectors are brought together and are mechanically joined, at least one detent engages so as to position said two connectors in a preferred angular relationship.

12. A connector according to claim 1 wherein said arcuate contact surface has at least one depression so that when two said connectors are brought together and are mechanically joined, said button with resilient mounting means on a first one of said two connectors finds a low-energy position in said at least one depression on a second one of said two connectors, so that said button with resilient mounting means and said at least one depression act as a detent which tends to position said two connectors in one of a specific angular position and a specific range of angular positions.

13. A connector according to claim 12 wherein said at least one depression is formed as a dimple so that said low-energy position occurs at a specific angular position.

14. A connector according to claim 12 wherein said at least one depression is formed as a plurality of dimples having a common radius from said center of said fluid pressure communication port whereby low-energy positions are established at a plurality of angular positions of said two connectors.

15. A connector according to claim 12 wherein said at least one depression is formed as an arcuate depression so that a low-energy position is established for a range of angular positions of said two connectors.

16. A connector according to claim 1 wherein said means for mechanically joining comprises projections on said connector body, such that when two said connectors are brought together with their said centers of their said fluid pressure ports juxtaposed, and rotated relatively about an axis passing substantially through their said centers of their said fluid pressure ports; their said projections engage, so as to join mechanically said two connectors.

17. A connector according to claim 16 wherein said projections are arcuate projections, having as arc center said center of said fluid pressure port.

18. A connector according to claim 17 wherein the number of arcuate projections on said connector is two.

19. A connector according to claim 16 wherein a plurality of said projections are made of electrically conductive material, are connected to electric conduction lines, and are otherwise insulated, so that said projections provide additional electrical contacts between said two connectors.

20. An electrical connector module for retrofitting onto an existing railroad car fluid pressure hose connector, said electrical connector module comprising:

(a) means for attaching said electrical connector module to said railroad car fluid pressure hose connector;

(b) a surface for electrical interconnection, having at least one electrical contact thereon, so that when a first fluid pressure hose connector having a first one of said electrical connector modules attached is joined to a second fluid pressure hose connector, having a second one of said electrical connector modules attached, at least one electrical interconnection is made between at least one of said electrical contacts on said first one of said electrical connector modules and at least one of said electrical contacts on said second one of said electrical connector modules; and (c) means for attaching an electrical conduction line to said at least one electrical contact.

21. The electrical connector module of claim 20 further comprising a detent, so that when two such electrical connector modules are attached to fluid pressure hose connectors which are then joined, at least one detent engages between said two such electrical connector modules, which serves to position said two electrical connector modules at a preferred angular relationship.

22. An electrical connector module according to claim 20 wherein said at least one electrical contact comprises an arcuate contact surface and a button with resilient mounting means so that when a first fluid pressure hose connector having a first one of said electrical connector modules attached is joined to a second fluid pressure hose connector, having a second one of said electrical connector modules attached, at least one electrical interconnection is made between one of said buttons with resilient mounting means on a first one of said electrical connectors and one of said arcuate contact surfaces on a second one of said electrical connectors.

23. An electrical connector module according to claim 20 wherein said at least one electrical contact comprises an arcuate contact surface and a button with resilient mounting means so that when a first fluid pressure hose connector having a first one of said electrical connector modules attached is joined to a second fluid pressure hose connector, having a second one of said electrical connector modules attached, two electrical interconnections are made as follows:

(a) between one of said buttons with resilient mounting means on said first electrical connector module and one of said arcuate contact surfaces on said second electrical connector module; and (b) between one of said buttons with resilient mounting means on said second electrical connector module and one of said arcuate contact surfaces on said first electrical connector module.

24. An electrical connector module according to claim 22 wherein said at least one button with resilient mounting means is a spring-loaded ball.

25. An electrical connector module according to claim 20 wherein Item (a), means for attaching to said fluid pressure hose connector, comprises a portion having a mounting hole which bolts to a carrier hole of said fluid pressure hose connector; said electrical connector module having a portion with a substitute carrier hole.

* * * * *

UNITED STATES PATENT AND TRADEMARK OFFICE

CERTIFICATE OF CORRECTION

PATENT NO. : 5,586,668

DATED : December 24, 1996

INVENTOR(S) : Craig A. Miller

It is certified that error appears in the above-identified patent and that said Letters Patent is hereby corrected as shown below:

Column 1, line 6, before "invention", please insert --This--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*